US008831455B2

(12) United States Patent
Swing et al.

(10) Patent No.: US 8,831,455 B2
(45) Date of Patent: Sep. 9, 2014

(54) METHODS AND SYSTEMS FOR MITIGATING FUSER ROLL EDGE WEAR USING VARIABLE END-POINT REGISTRATION DISTRIBUTION SYSTEM CONTROL

(75) Inventors: Jeffrey Nyyssonen Swing, Rochester, NY (US); Christopher Jensen, Rochester, NY (US); Melissa Ann Monahan, Rochester, NY (US); Erwin Ruiz, Rochester, NY (US); Steven Matthew Russel, Bloomfield, NY (US); Paul M. Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 153 days.

(21) Appl. No.: 13/406,361

(22) Filed: Feb. 27, 2012

(65) Prior Publication Data

US 2013/0223858 A1 Aug. 29, 2013

(51) Int. Cl.
*G03G 15/20* (2006.01)

(52) U.S. Cl.
USPC ..... 399/67; 399/328

(58) Field of Classification Search
USPC ..... 399/33, 67, 320, 328, 329; 219/216
See application file for complete search history.

(56) References Cited

U.S. PATENT DOCUMENTS

| | | | | |
|---|---|---|---|---|
| 5,323,216 | A * | 6/1994 | Mahoney | 399/45 |
| 7,013,107 | B2 | 3/2006 | Russel et al. | |
| 7,457,574 | B2 * | 11/2008 | Spence et al. | 399/322 |
| 7,941,084 | B2 * | 5/2011 | Li et al. | 399/328 |
| 8,116,671 | B2 * | 2/2012 | Li et al. | 399/329 |
| 8,265,534 | B2 * | 9/2012 | Hamby et al. | 399/328 |
| 2008/0145115 | A1 | 6/2008 | Spence et al. | |
| 2010/0284713 | A1 | 11/2010 | Li et al. | |

FOREIGN PATENT DOCUMENTS

JP 2002296947 A * 10/2002

* cited by examiner

*Primary Examiner* — Robert Beatty
(74) *Attorney, Agent, or Firm* — Ronald E. Prass, Jr.; Prass LLP

(57) ABSTRACT

Methods include moving a fuser assembly with respect to a medium at a fusing nip. The fuser assembly may be moved back and forth, axially in a media cross process direction for registration distribution. The system may be configured to move the fuser assembly different distances based on a deduction of a current location of a fuser member in view of a known driving motor speed, and a time elapsed after a change in signal state. Systems may incorporate one or two sensors, and may be configured for axial movement over a distance of 2 mm or a distance of 55 mm. signature.

19 Claims, 8 Drawing Sheets

METHODS AND SYSTEMS FOR MITIGATING FUSER ROLL EDGE WEAR USING VARIABLE END-POINT REGISTRATION DISTRIBUTION SYSTEM CONTROL

RELATED APPLICATIONS

This application is related to United States Patent Application Publication No. 2008/0145115 entitled "Fuser Roll Edge Wear Smoothing System and Method," and U.S. patent application Ser. No. 12/463,611 entitled "Apparatuses Useful For Printing And Methods of Mitigating Edge Wear Effects In Apparatuses Useful For Printing," each filed on May 20, 2011, the disclosures of which are incorporated by reference herein in their entirety.

FIELD OF DISCLOSURE

The disclosure relates to mitigating effects of fuser roll edge wear on prints in printing methods and systems. In particular, the disclosure relates to methods and systems for mitigating fuser roll edge wear by controlling axial fuser roll movement using dead reckoning techniques.

BACKGROUND

Paper edge wear is a dominant cause of fusing system failure. Apparatus useful for printing and methods of mitigating edge wear effects in apparatus useful for printing are disclosed by Russel et al. in U.S. Pat. No. 7,013,107, entitled "Systems and Methods For Continuous Motion Registration Distribution With Anti-Backlash and Edge Smoothing." Apparatus and systems configured with a registration distribution system may include a first member including a first outer surface; and a second member. The first member or the second member may be a fuser roll or belt. For example, the second member may be a fuser roll including a conformable second outer surface forming a nip with the first outer surface; and a registration distribution system including a motor for translating at least the second member, relative to a medium passing through the nip, the second member being translated between a first home position and a second home position, or a limit position and a home position.

The motor may be connected to a fuser drawer, which is connected to the fuser roll. The motor may be configured to cause the fuser drawer to move between two limit sensors, the fuser drawer having a flag attached thereto for triggering a change in state of the sensors. Typically, the registration distribution system is configured to cause the fuser drawer move continuously between the two sensors, being caused to change direction in response to a changing signal state at the limit position or the home position, which corresponds to a maximum travel point or a starting travel point in a given direction. The distance between the limit position and the home position may be about 34 mm, to accommodate fuser roll axial travel control over a 34 mm zone. Accordingly edge wear may be spread across the 34 mm zone.

SUMMARY

Paper edge wear causes image quality defects such as a gloss shift in a printed document. While related art registration distribution systems mitigate paper edge wear by, for example, accommodating axial fuser roll travel across a 34 mm zone, such system may nonetheless produce prints that exhibit evidence of edge wear. Paper edge wear may result from backlash, or edge wear caused at a turn-around point at a first end and/or second end, axially, of the, e.g., 34 mm zone of fuser roll travel. Moreover, stage fuser rolls used to mitigate backlash effects exhibited in prints produced using a registration distribution system may be subject enhanced edge wear over time that results in image quality defects.

Methods and systems are provided that accommodate enhanced control over page-wear mitigating axial fuser roll travel. This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

In an exemplary embodiment, methods may include causing a fuser member to move axially in a first process direction at a known speed; detecting when the fuser member passes a sensor position in the first direction; and causing the fuser member to move in a second direction after a first period of time elapses. In an embodiment, methods may include detecting when the fuser member passes a home sensor position in the second direction. Methods may include causing the fuser member to move in the first direction after a first period of time elapses after the fuser member passes the home sensor a first time. Methods may include causing the fuser member to move in the second direction after a second period of time elapses.

In an embodiment, methods may include the second period of time being equal to the first period of time. Methods may include causing the fuser member to move in the second direction after a second period of time elapses after the fuser roll passes the limit sensor a second time. Methods may include the second period of time being equal to the second period of time. In embodiments, the fuser member may be a fuser apparatus, a fuser roll, a pressure roll, a fuser belt or a fuser drawer or fuser roll support structure.

In an embodiment, the sensor may be a home sensor, and methods may include detecting when the fuser member passes the home sensor position in the second direction. Methods may include causing the fuser member to move in the first direction after a second period of time elapses after the fuser roll passes the home sensor a second time. Methods may include causing the fuser member to move in the second direction after a third time period elapses. In an embodiment, methods may include the third time period being a time period that is different than a first time period and a second time period. Methods may include the third time period being a time period that is different than a time period elapsed during a previous movement of the fusing member in the first direction after passing the home sensor. In an embodiment, methods may include causing the fuser member to move in the first direction after a fourth time period, the fourth time period being different than the second time period or a time period elapsed during a previous movement of the fusing member in the second direction after passing the home sensor.

In an embodiment, a non-transitory computer readable medium may contain computer readable instructions including causing a fuser member to move axially in a first process direction at a known speed; detecting when the fuser member passes a sensor position in the first direction; and causing the fuser member to move in a second direction after a first period of time elapses. In an embodiment, a computer readable medium may contain instructions, the sensor being a limit sensor, including detecting when the fuser member passes a home sensor position in the second direction; causing the fuser member to move in the first direction after a first period of time elapses after the fuser member passes the home sensor a first time; and causing the fuser member to move in the second direction after a second period of time elapses. In an embodiment, a computer readable medium may contain instructions including detecting when the fuser member passes the home sensor position in the second direction; and causing the fuser member to move in the first direction after a second period of time elapses after the fuser roll passes the home sensor a second time.

In an embodiment, methods may include a method for mitigating fuser member edge wear, comprising causing a fuser member to move axially in a first cross-process direction until a first end point; causing the fuser member to move axially in a second cross-process direction; causing a fuser member to move axially in the first cross-process direction until a second end point, the second point being different than the first point. Methods may include detecting when the fuser member reaches the first end point; and detecting when the fuser member reaches the second end point. Methods may include causing the fuser member to move axially in the second cross-process direction to a third end point; causing the fuser member to move axially in the first cross-process direction to a fourth end point; and causing the fuser member to move axially in the second cross-process direction to a fifth end point, the fifth point being different than the third point, and the first point, the second point, the third point, the fourth point, and the fifth point being disposed along a line corresponding to a longitudinal axis of the fuser member.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
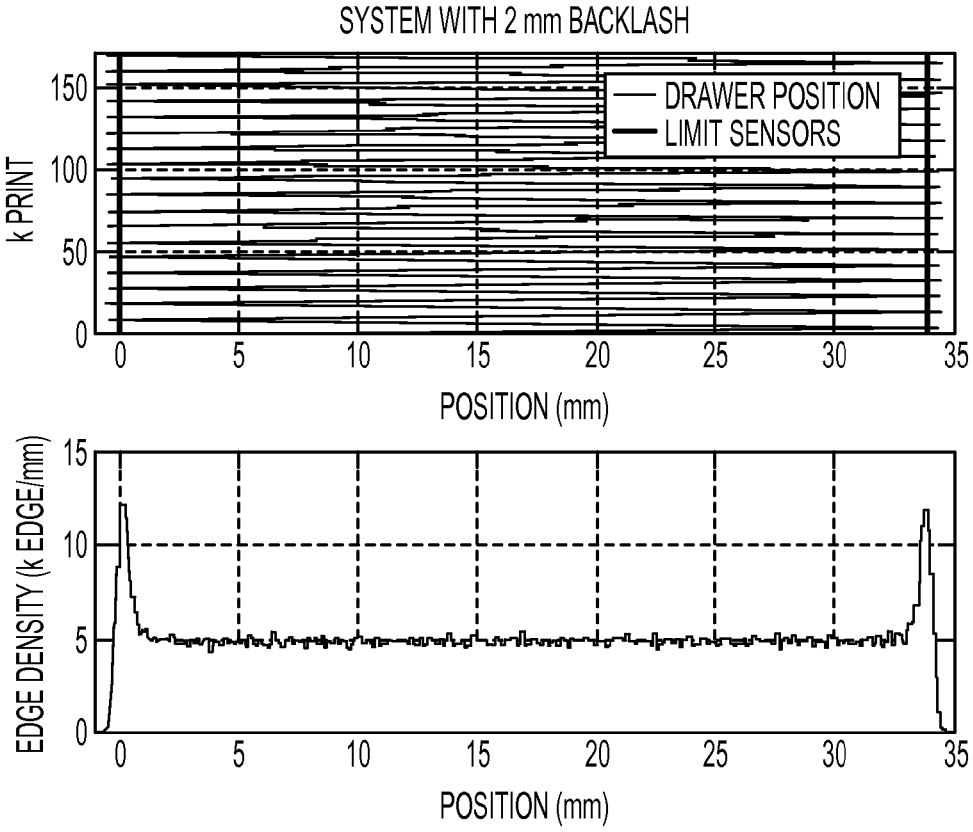
FIG. 1 RELATED ART
FIG. 1 shows a graph depicting an edge wear profile and drawer motion of a related art registration distribution system.

Exemplary embodiments are intended to cover all alternatives, modifications, and equivalents as may be included within the spirit and scope of the apparatus and systems as described herein.

Reference is made to the drawings to accommodate understanding of methods and systems for mitigating fuser roll edge wear using dead reckoning-based registration distribution system control. In the drawings, like reference numerals are used throughout to designate similar or identical elements. The drawings depict various embodiments and data related to embodiments of illustrative systems and methods mitigating fuser roll edge wear using dead reckoning-based registration distribution control.

Fuser systems for printing apparatus and systems may include a first member and a second member that define a fusing nip for applying pressure, and in some systems thermal energy, to fuse marking material such as toner or ink to media such as a paper sheet. One of these rolls is typically conformable, while the other is solid. When a paper sheet, or other suitable medium, is fed through a nip defined by the first member and the second member, e.g., a fuser roll and a pressure roll, the conformable roll applies pressure to the solid roll. The conformable roll must bend sharply around the edge of the paper sheet positioned at a media registration edge. This sharp bend produces concentrated stress in the outer layer of the conformable roll. Consequently, the outer layer of the conformable roll may be abraded and/or degraded. An elastomeric layer under the outer layer of the fuser roll may also become degraded. Such edge wear is typically the dominant failure mode for nip-forming fuser rolls, such as the fuser roll. Edge wear also causes differential gloss artifacts in images formed on media when such surface defects in the outer surface are transferred to media, thereby reducing print quality. Such wear also occurs in belts of belt roll fusers.

To mitigate the severity of edge wear in such nip-forming fuser rolls where the fuser roll is conformable and the pressure roll is solid, the fuser assembly including the fuser roll and pressure roll can be translated axially between maximum travel positions using a registration distribution system (RDS) as disclosed in U.S. Pat. No. 7,013,107, which is incorporated herein by reference in its entirety.

Apparatus and systems configured with a registration distribution system may include a first member, such as a roll, including a first outer surface; a second member, such as a roll. The first member or the second member may be a fuser roll. For example, the second member may be a fuser roll including a conformable second outer surface forming a nip with the first outer surface; and a registration distribution system including a motor for translating at least the second member, relative to a medium passing through the nip, the second member being translated between a first home position and a second home position, or a limit position and a home position.

The motor may be connected to a fuser drawer, which is connected to the fuser roll. The motor may be configured to cause the fuser drawer to move between two sensors, the fuser drawer having a flag attached thereto for triggering a change in state of the sensors. Typically, the registration distribution system is configured to cause the fuser drawer move continuously between the two sensors, being caused to change direction in response to a changing signal state at the limit position or the home position. The distance between the limit position and the home position may be about 34 mm, to accommodate fuser roll axial travel control over a 34 mm zone. Accordingly edge wear may be spread across the 34 mm zone.

In registration distribution systems including a drive motor that stops and reverses direction when a maximum travel position is reached at either the first or second end of the roll travel zone, backlash may occur in the drive system during the stopping and reversing of direction by the drive motor. For example, in registration distribution systems including a drive motor that moves the fuser assembly continuously from one maximum travel position to the other, there is a dwell period due to drive motor reversal at the end of each travel of the fuser assembly from one maximum travel position to the opposite maximum travel position. Backlash results in loss of motion of the fuser assembly at the maximum travel positions for the dwell period. During each dwell period, extra media pass over the same section of the fuser roll surface before motion of the fuser roll in the opposite direction is resumed. The extra media increases edge wear at the sections of the fuser roll surface.

Backlash causes image quality defects. For example, FIG. 1 shows a graph depicting an edge wear profile and corresponding drawer motion in a print operation using a related art distribution system in which fuser or pressure member or roll axial movement is reversed when the member reaches a maximum travel. FIG. 1 shows that related art registration distribution systems exhibits backlash in opposing end regions each of 2 mm in length. The tested system included an axial movement zone of 34 mm in length.

Related art registration distribution systems do not control the fuser roll translation based on a deduced understanding of the position of the roll. Instead, the controller is configured to cause the fuser roll to change a direction of travel based on a change in state of a sensor located at either end of the 34 mm zone; for example, a limit sensor and a home sensor. As such, during operation of the related registration distribution system, the fuser roll may be caused to change a direction of travel at two discrete points at a first and a second end of the zone of axial travel.

The first end of the zone of fuser roll axial travel defined by the registration distribution system may correspond to a limit position that is associated with a limit sensor. The second end may correspond to a home position that is associated with a home sensor. In related art systems, a limit sensor trip point at which a change of sensor state may be caused by detection of a flag, for example, is positioned at the first end of the zone of axial movement. Similarly, a home sensor trip point at which a change of sensor state may be caused by detection of a flag, for example, is positioned at the second, opposite end of the zone of axial movement.

Figure 2:
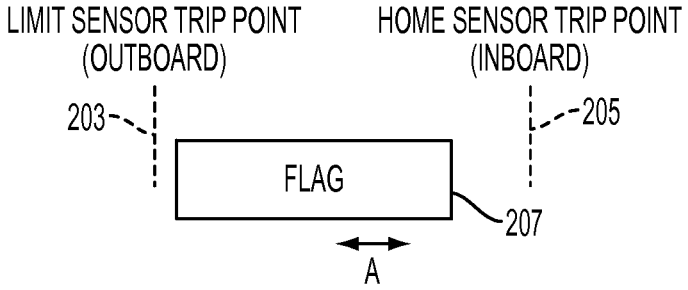
FIG. 2 shows a diagrammatic view of a sensor arrangement of a related art registration distribution system.

FIG. 2 shows a diagrammatic view of a sensor arrangement of a related art registration distribution system. As shown in FIG. 2, related art distribution systems may include a limit sensor or outboard sensor at a first end 203 of a registration distribution axial movement zone. Systems may include a home sensor or inboard sensor at positioned at a second end 205 of the registration distribution axial movement zone. A flag 207 connected to an axially movable fuser roll and the inboard sensor 205 and outboard sensor 203 may be configured so that the flag 207 trips one of the outboard sensor 203 and the inboard sensor 205 as the flag 207 is caused to move in directions corresponding to the arrow "A" of FIG. 1. Thus, control over axial movement of the fuser roll depends on a change in sensor state of a limit sensor or a home sensor, limiting the registration distribution system to fuser roll movement between two fixed end points at which a direction of fuser roll movement is reversed. Usage of a print system having a related art registration distribution system may cause paper edge wear at the two fixed end points due to repeated axial roll turn-around procedures.

Paper edge wear may cause corresponding image quality defects such as a gloss shift in a document printed with printing systems. While related art registration distribution systems mitigate paper edge wear by, for example, accommodating axial fuser roll travel across a 34 mm zone, prints produced by such systems may nonetheless exhibit edge wear. Paper edge wear may result from backlash, or edge wear caused at a turn-around point at a first end and/or second end, axially, of the, e.g., 34 mm zone of fuser roll travel. Moreover, stage fuser rolls used to mitigate backlash effects exhibited in prints produced using a registration distribution system may be subject enhanced edge wear over time that results in image quality defects.

Methods and systems are provided that accommodate enhanced control over page-wear mitigating axial fuser roll and/or pressure roll travel. This disclosure is not limited to the particular systems, devices, and methods described, as these may vary. The terminology used in the description is for the purpose of describing the particular versions or embodiments only, and is not intended to limit the scope.

Methods and systems may include mitigating an effect of paper edge wear on an outer layer of, for example, a fuser roll by moving a fuser roll or pressure member of a fusing nip axially with respect to a process direction of media processed at the nip. Methods and systems accommodate enhanced mitigation of paper edge wear by enhanced control over the axial motion of the, for example, fuser roll. This allows for implementing variable end points at which an axial motion of the fuser roll stops or reverses motion, thus mitigating the effects of repetitive page edge contact at points or areas on an outer layer of the fuser roll.

While methods may be preferably implemented using dead-reckoning methods and systems as described herein by way of example, other methods may be implemented for accomplishing variable endpoint axial respective fuser member movement for edge wear mitigation. For example, an alternative embodiment of systems and methods may include causing a fuser member to move relative to a pressure member in back-and-forth axial directions, varying endpoints in repeated motions. Rather than relying on dead-reckoning to determine a location and turn-around point of a fuser member, a fuser member may be monitored by a sensor system configured for continuously sensing a real-time position of the fuser member. Exemplary sensor systems may include, for example, continuous sensor systems such as a linear encoder or linear variable differential transformer.

For example, methods and systems may include varying a point at which a fuser roll or fuser roll drawer is caused to travel in a substantially axial, media cross process motion before stopping or turning around. By varying an endpoint of travel along a zone of axial fuser member motion, smoothing may be enhanced, and backlash, for example, may be mitigated. An area of the zone of motion may an end zone of a particular length in which a fuser member may be caused to stop or turn around at varying points. An end zone may be defined by intervals, which may correspond to discrete turn-around points within the end zone of fuser member axial motion.

In an embodiment, a fuser registration distribution system may define a zone of motion 34 mm in length. At either end of the zone of fuser member motion, an end zone may be defined, the end being 5 mm in length, for example. A sensor system may be implemented and configured for detecting a flag position. Computer readable instructions may be implemented and configured for estimating a position of the fuser roll based on a motor speed and a time the motor has been running. Computer readable instructions may be implemented and configured to monitor and record a number of turn-arounds of fuser member in each of a first and second end zone.

Figure 3:
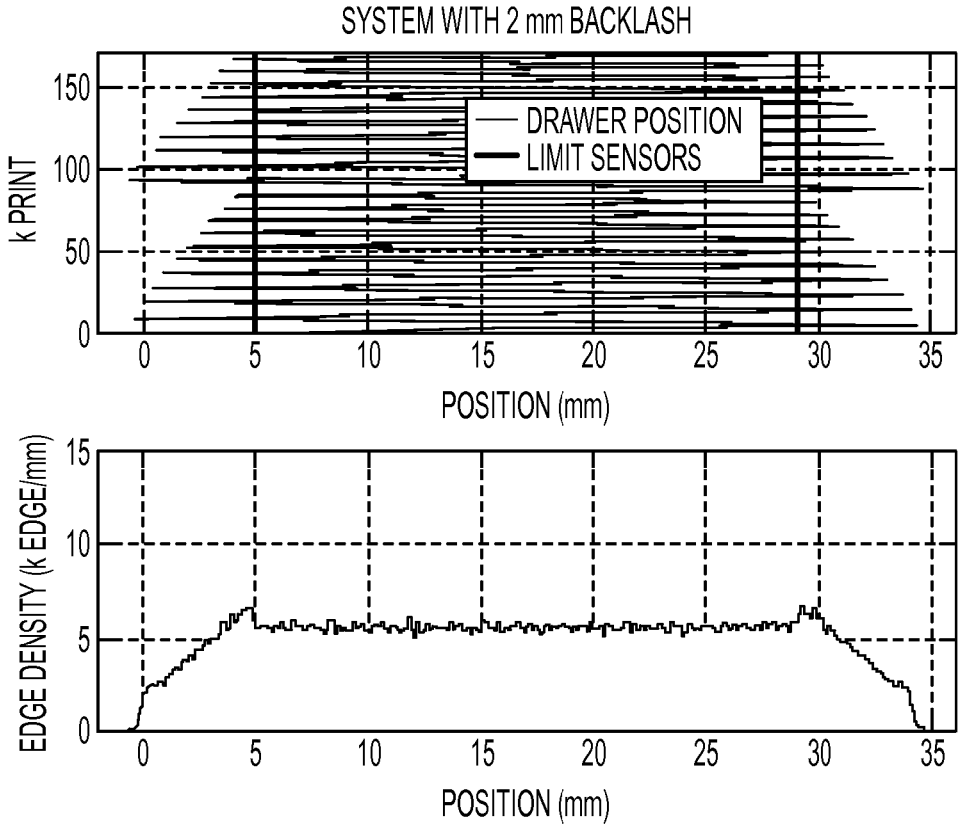
FIG. 3 shows a graph depicting an edge wear profile produced by methods and system in accordance with an embodiment.

During printing, a controller connected to, for example, a fuser roll drawer of a fuser assembly may cause the fuser roll to move axially from a first home position at a first end point of a zone of motion to a second home position. These positions may also be referred to as a limit position and a home position. A turnaround position of the fuser roll may be varied to spread any effects of backlash over an area. As compared to the related art, a resulting step profile may be smoothed, minimizing a gloss differential. For example, FIG. 3 shows a 2 mm backlash model like that used to produce the results shown in FIG. 1. The smoothing is improved over that accommodated by related art systems and methods, and characterized by a wider triangular-shaped base, and/or trapezoidal-shaped smoothing profile.

Figure 4:
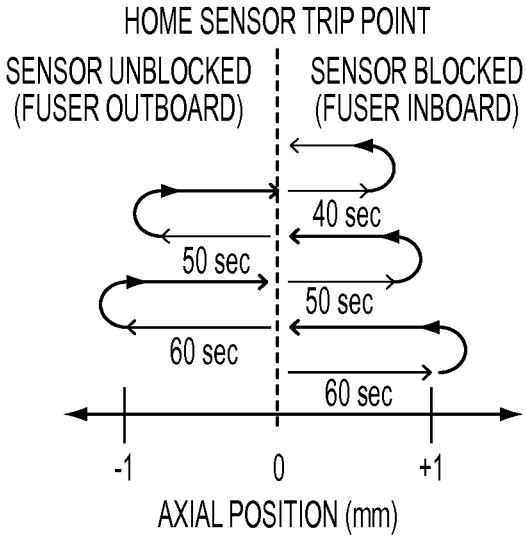
FIG. 4 shows a graph depicting enhanced smoothing profile produced by methods and system in accordance with an embodiment.

As shown in FIG. 4, an enhanced smoothing profile may be accomplished by varying a turnaround point of a fuser member that is caused to move axially for registration distribution. For example, a fuser member may include a flag. The member may be driven past one of a home sensor or a limit sensor. The fuser member may driven past the sensor after the sensor is blocked by the flag until the system causes the fuser member to turn around or stop at a certain location, which may be variable where repeated axial motion is performed. The fuser member may be caused to turn around or reverse motion after a particular time. The fuser member may be driven at a constant speed, for example, of about 1 mm per minute, and the position of the fuser member may be tracked based on a length of time that the motor is on. After the fuser member reverses direction, the fuser member may be driven past the same sensor or a sensor located at an opposite end zone.

In an embodiment, the fuser member may be driven to variable end points within an end zone as shown in FIG. 4. Such a process may be carried out at both an outboard end and an in board end of a zone of axial motion using both an outboard sensor and an in board sensor. At a first outboard end zone of a zone of fuser member axial motion, a first home position or limit position sensor may be arranged at a point 5 mm from an end thereof. At 29 mm from the end of the first end zone, a second home position sensor may be arranged. The zones may each be divided in increments of 10. Computer readable instructions may be implemented, for example, for causing a fuser member such as a fuser roll and/or fuser roll drawer to move axially past each of the limit sensor and the home sensor repeatedly for a number of times, and turn around at varying points on each pass. After, for example, ten passes corresponding to the ten intervals are complete, the process pattern may start again. For example, computer readable instructions may be implemented for causing a system to move a fuser member axially with respect to a media process direction by starting a turnaround point at each end zone at a furthest distance in a beginning of the process, and causing the turnaround positions to approach the nip toward the end of the process.

Figure 5:
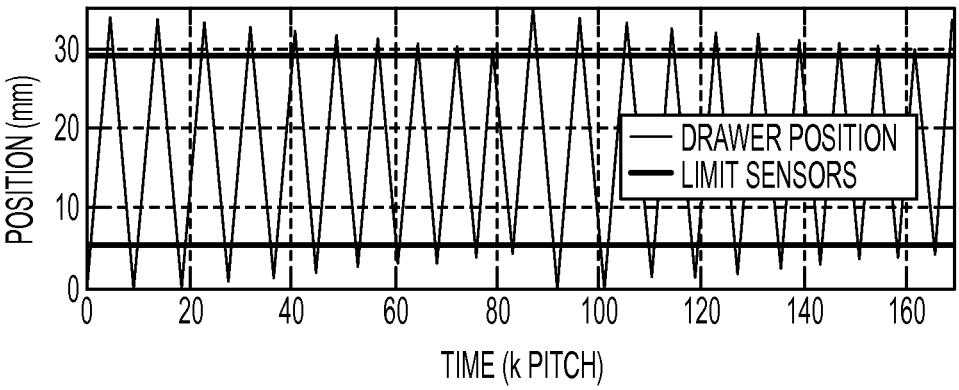
FIG. 5 shows a graph depicting results of a simulation including two cycles of motion for a 5 mm end zone with ten intervals.

FIG. 5 shows a graph depicting results of a simulation including two cycles of motion for a 5 mm end zone with ten intervals produced in accordance with exemplary methods and systems. The depicted results were based on a run of 170,000 prints. It was found that the width of each incremental step, 0.5 mm should be near a total tolerance for paper registration error, e.g., plus or minus 0.5 mm. If paper registration error is not sufficient, a random number may be added to each turnaround position to cause a smoother profile.

Systems may include a fuser for printing systems. A fuser may include a fuser roll or belt. A fuser may include a pressure roll or belt, or other suitable structure. The fuser roll may be driven by a drive mechanism, and the pressure roll may be connected to a cam. The fuser roll and pressure roll rotate in opposite directions. The fuser roll and the pressure roll may apply and/or pressure to media at the nip to treat marking material on the media.

A fuser roll may include a core, an inner layer on the core, and an outer layer on the inner layer. The core may comprise aluminum, or the like. An inner layer may comprise an elastomeric material, such as silicone, or the like. The outer layer may comprise a fluoroelastomer sold under the trademark Viton® by DuPont Performance Elastomers, L.L.C., or the like. The outer layer may include the outer surface. The outer surface may be conformable.

A pressure roll may include a core, and an outer layer on the core. In an exemplary embodiment, the core may be comprised of aluminum or the like, and the outer layer of a perfluoroalkoxy (PFA) copolymer resin or the like.

An alternative system may include a fuser comprising a continuous fuser belt having an inner surface and an outer surface. The belt may comprise a base layer of polyimide, or like polymer; an intermediate layer of silicone, or the like, on the base layer; and an outer layer comprised of a fluoroelastomer sold under the trademark Viton® by DuPont Performance Elastomers, L.L.C., or a like polymer, on the intermediate layer.

One of the fuser members may be moved in an axial direction to spread effects of edge wear across an area of the member. The fuser member(s) may be caused to move by way of a controller that is configured to cause member, e.g., fuser roll, movement based on sensor readings from a sensor system. A sensor system may be configured to include a sensor at one or both of a home position and a limit position of a zone of axial motion of a fuser member.

Figure 6:
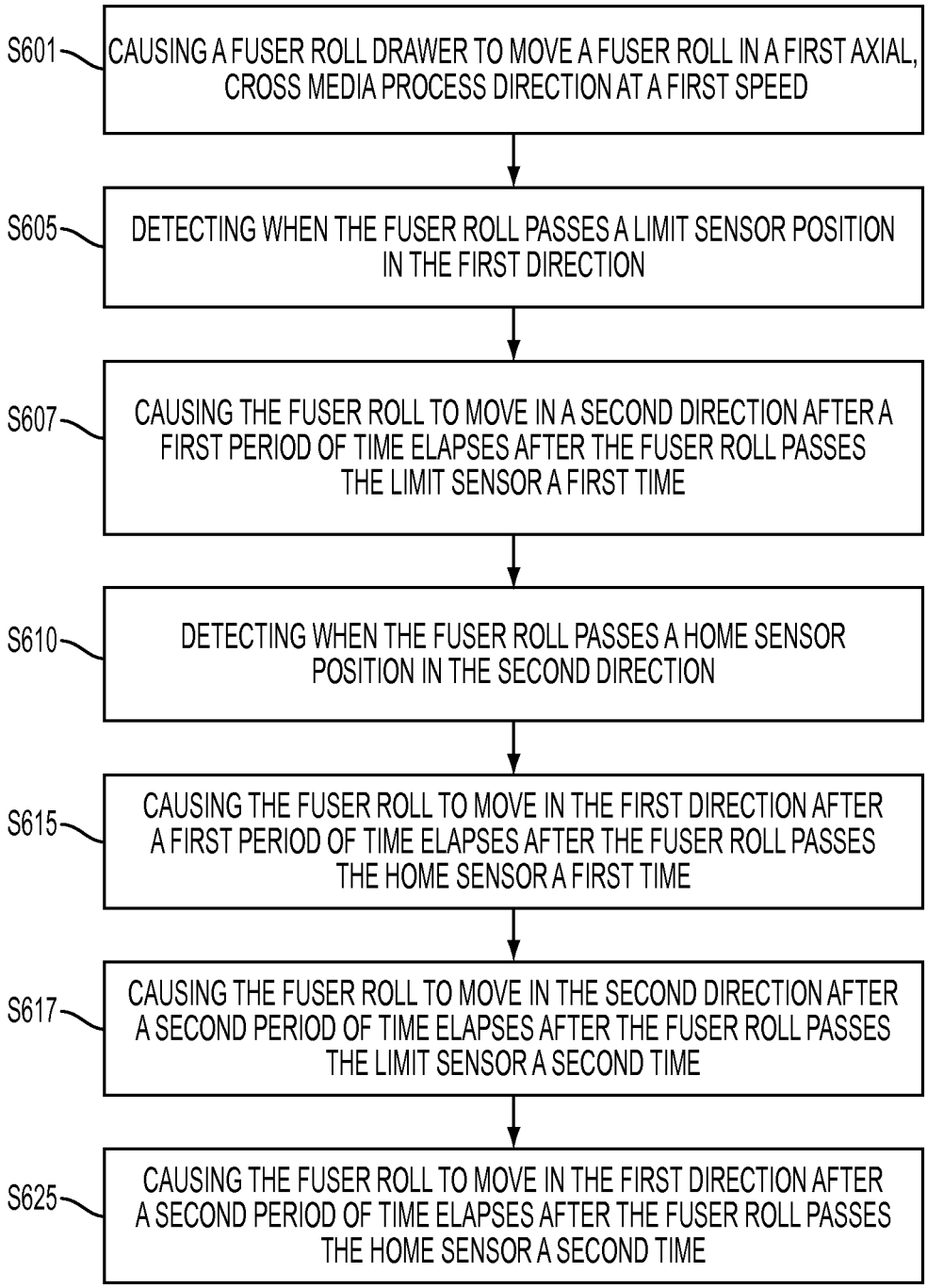
FIG. 6 shows methods of edge wear mitigation using a two-sensor fuser member registration distribution system in accordance with an embodiment.

FIG. 6 shows methods of mitigating edge wear in a fusing system equipped with a first sensor and a second sensor. The first sensor may be located at a home position at an inboard end of a zone of motion, with respect to a media cross-process direction. The first sensor may be located a distance from the end of the inboard end. A second sensor may be located at a limit position at an outboard end of the zone of motion. The second sensor may be located a distance form the end of the outboard end.

As shown in FIG. 6, methods may include causing a fuser roll drawer to move a fuser roll in a first axial, cross media process direction at a first speed at S601. The speed may be constant throughout the registration distribution process.

Methods may include detecting when the fuser roll passes a limit sensor trip point at an outboard end of a fuser member or fuser member zone of axial motion at S605. For example, a sensor may be triggered as a flag attached to a fuser member in motion passes a sensor to unblock the sensor. Methods may include causing a fuser roll to move in a second direction after a period of time elapses after the fuser roll passes the limit sensor a first time in a process at S607. The second direction may be an opposite axial direction with respect to the first direction. For example, the first direction may be a direction toward an outboard side of a fuser. The second direction may be a direction toward an inboard side of a fuser.

Methods may include detecting when a fuser roll passes a home sensor position at S610. For example, methods may include detecting when a fuser roll passes the home sensor as the fuser travels in the second direction. Methods may include causing the fuser roll to move in the first direction at S615 after a first period of time elapses after the fuser roll passes the home sensor a first time.

Methods may include causing the fuser roll to move in the second direction after a second period of time elapses after the fuser roll passes the limit sensor a second time at S617. Methods may include causing the fuser roll to move in the first direction after a second period of time elapses after the first roll passes the home sensor a second time. Methods may include causing the fuser roll to move in each of the first and second direction four and more times each. In each successive movement past a home or limit sensor, a period of time that elapses may be different than a previous movement of the fuser roll past that sensor. For example, a fuser roll may be caused to move past a home sensor to different points located at different distances past the sensor trip point for each passage of the fuser roll by the sensor.

Some systems may implement a single sensor, rather than both a home sensor and a limit sensor. For example, systems my include one of the limit sensor or home sensor. Such systems may be useful for extending a life stage fuser roll, for example. Stage rolls may be used to mitigate the effects of related art registration distribution systems. Related art registration distribution systems may be configured to move an entire fuser back and forth in a cross-process direction to spread paper edge wear over a 34 mm zone. Edge wear zone(s) that cover a surface of a fuser member may have a higher roughness than a rest of the member. Printing system users running prints of different page sizes experience failure modes characterized by multiple edges wear zones, which may be in an image area of a fuser member. A corresponding image area may show lower gloss and lead to early component replacement.

Figure 7A:
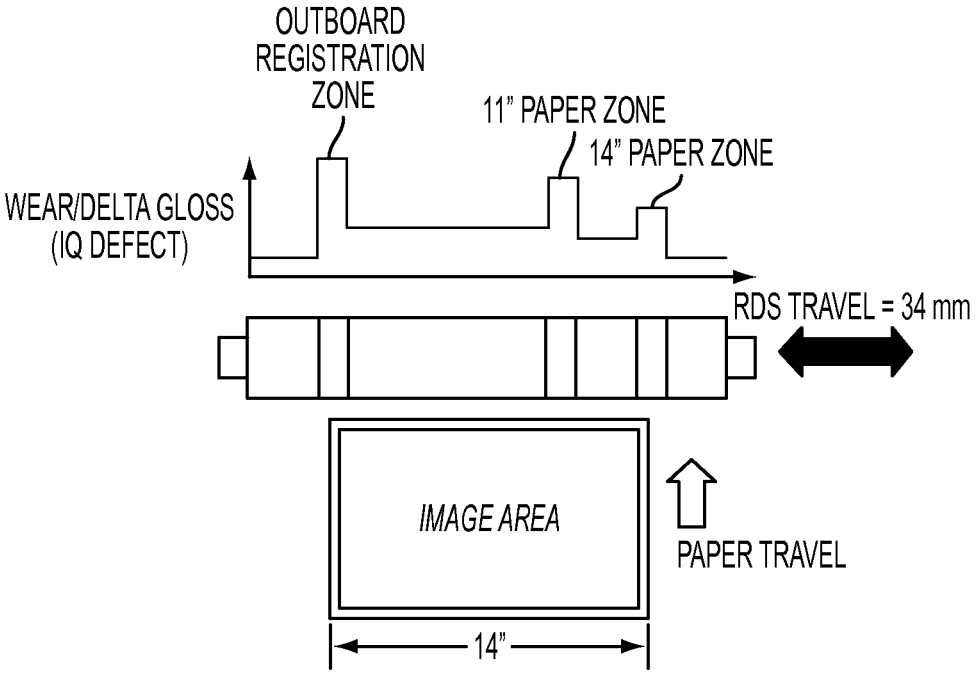
FIG. 7A RELATED ART
FIG. 7A shows an edge wear profile for a related art system.
Figure 7B:
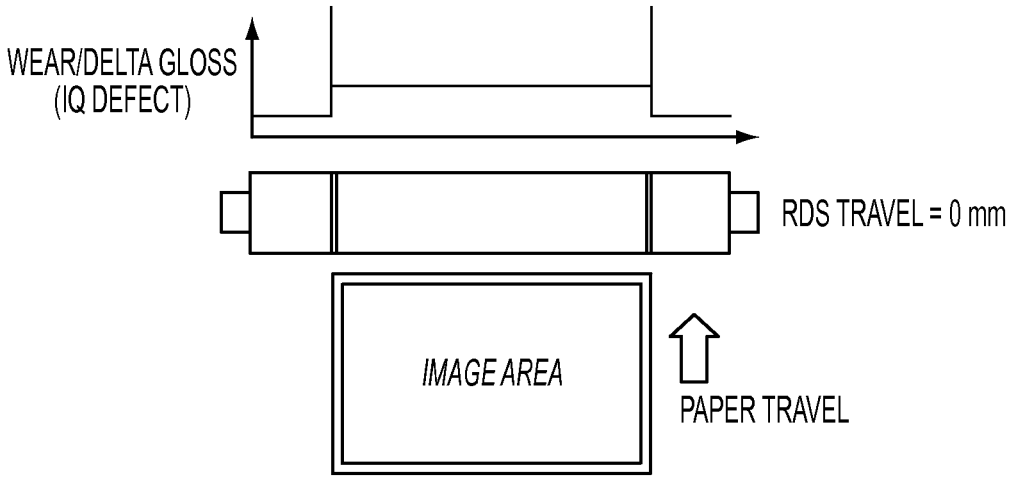
FIG. 7B RELATED ART
FIG. 7B shows an edge wear profile for a related art system.

FIG. 7A shows an edge wear profile for a related art registration distribution system in a system running multiple page size prints. As shown in FIG. 7B, worn areas of a fusing member such as a fuser roll may develop. When the used fuser roll is used to print on a page that is a 14" page, for example, a wear zone that corresponds to an edge of previously fused 11" pages may caused image quality defects in prints because the wear zone is in the image area of the fuser roll with respect to the larger 14" page size. To address this issue, users running limited page size prints may use stage rolls wherein wear zones of a fuser roll are only on regions that are outside of an image region. A user may stage a roll to be used with a particular sheet width, e.g., 11", 14", 297 mm, etc.

To use a stage roll, however, users typically disable any registration distribution system so that a zone of axial cross-process motion of a fuser member is substantially 0 mm. A usual edge wear profile that results from such stage roll implementation is shown in FIG. 7B. The edge wear is concentrated, and the staged roll eventually fails as the edge wear cuts through the top layer of Viton on the fuser roll. As the Viton layer becomes worn, a silicone underlayer may become impregnated with process oil, causing further failure modes and/or image quality defects.

Figure 8:
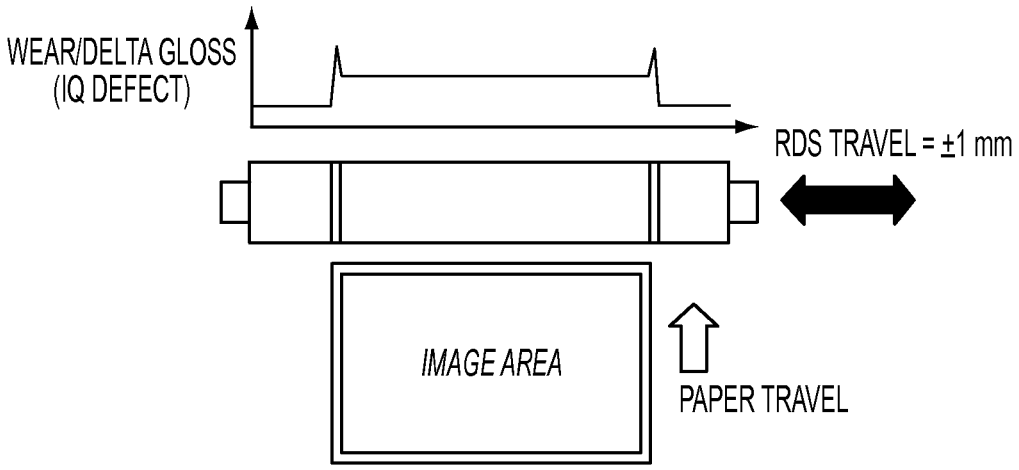
FIG. 8 shows enhanced wear profile accommodate by methods and system in accordance with an embodiment.

Methods and system of embodiments include using dead-reckoning techniques to mitigate concentrated page edge wear exhibit by stationary stage roll use. Methods may include moving fuser roll member back and forth to cause a smoothed wear profile. FIG. 8 shows a wear profile wherein prints exhibited minimal or imperceptible gloss differential. Because a stage roll includes a wear zone for which further wear is to be mitigated, a fuser member may be configured to be caused to move axially back and forth across a short distance. To do so, system may use a single sensor, such as a home sensor at a home location at one of an inboard and outboard end of a zone of axial motion of a fuser member. This allows back and forth axial motion of a fuser member that is iteratively variable across a short distance. For example, a fuser roll may be caused to move back and forth past a home sensor position, reversing direction of movement at different distances from the home sensor position with a short zone of motion, e.g., about 2 mm. A process starting time, ending time wherein the system cycles and beings again with the starting time and time decrease iterations are all design parameters that may be optimized for enhanced Viton wear and/or image quality.

Figure 9:
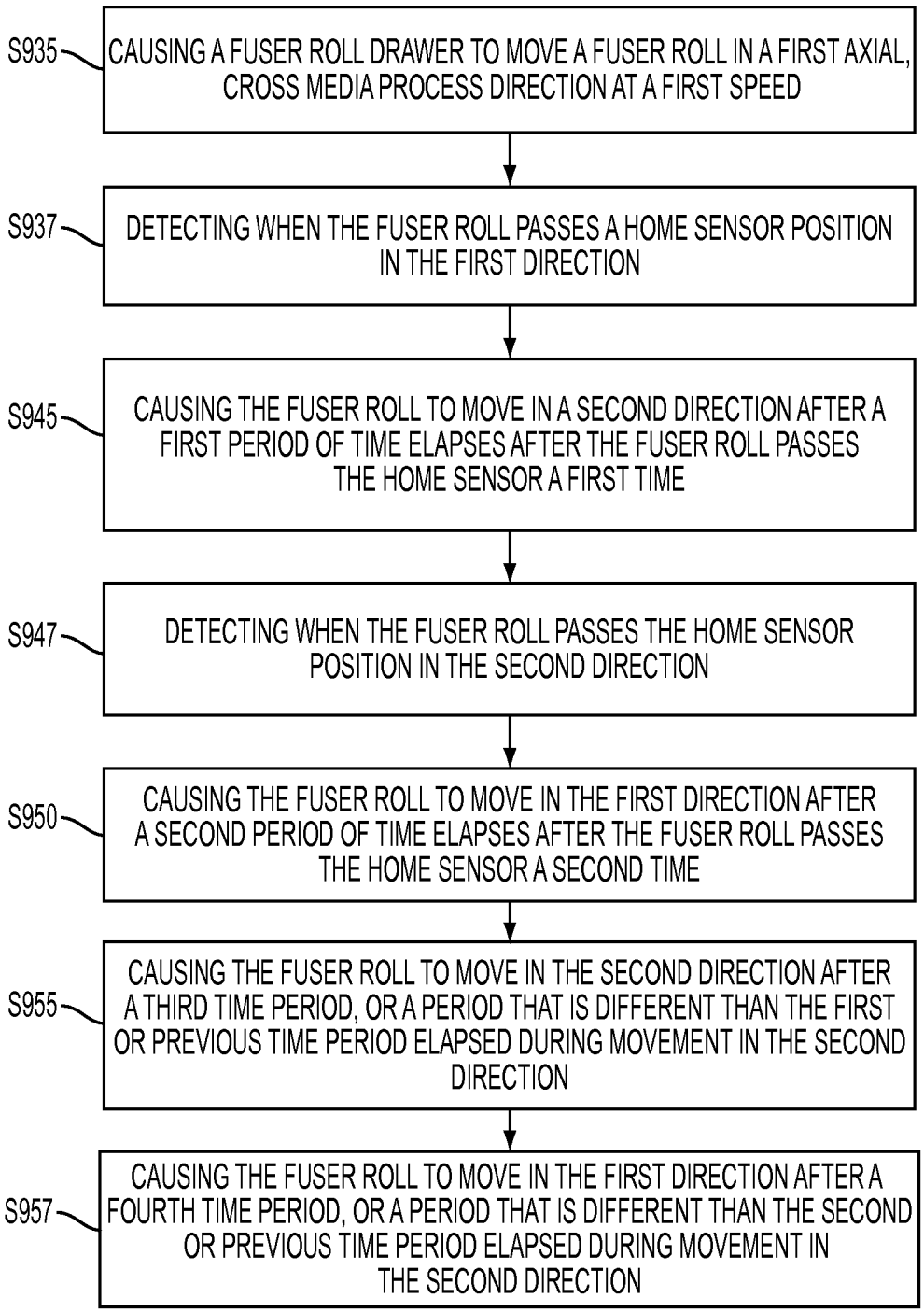
FIG. 9 shows methods of mitigating edge wear using a single sensor system.

FIG. 9 shows methods of mitigating edge wear of a stage fuser member using a fuser member zone of motion that is short in length, e.g., about 2 mm long. Methods may be implemented using a single sensor of a registration distribution system, for example. The sensor may be located at an end zone of a zone of fuser member motion in a cross-process or axial fuser member direction.

Methods may include causing a fuser roll drawer to move a fuser roll in a first axial, cross media process direction at a first speed at S935. A fuser member may be caused to move by a motor operating a speed of about 1 mm per minute. The fuser member location may be determined based on known motor speed, and a change in sensor state of a sensor configured to detect passage of a flag connected to the fuser member.

Methods may include detecting when the fuser roll passes a home sensor position as the fuser member travels at a constant speed in the first direction at S937. Methods may include causing the fuser roll to move in a second direction after a first period of time elapses after the fuser roll passes the home sensor a first at S945. A controller may be configured to determine when a period of time has elapsed, and may be configured to cause movement of the fuser member based on the determination.

Methods may include detecting when the fuser roll passes the home sensor position as the fuser roll travels in the second direction at S947. Methods may include causing the fuser roll to move in the first direction after a second period of time elapses after the fuser roll passes the home sensor a second time at S950. The second period of time may be the same as the first period of time. For example, a fuser roll may be caused to move past a home sensor position for a period of time in the first direction that is equal to a period of time in the second direction.

Methods may include causing the fuser roll to move in the second direction after a third time period that is different than the first time period at S955. For example, the fuser roll may be caused to travel a longer distance past a home sensor position during a first time a fuser member travels in the second direction than a second time a fuser member travels in the second direction. The fuser member axial travel distance may be controlled to be successively shorter for each pass of the fuser member across a home sensor position. After a shortest distance past a home sensor position is traveled during a process, the process may be repeated as necessary for printing operations.

Methods may include causing the fuser roll to move in the first direction after a fourth time period has elapsed at S957. The fourth time period may be a time period that is different than second time period or a previous time period. For example, the fuser roll may be caused to travel a longer distance past a home sensor position during a first time a fuser member travels in the first direction than a second time a fuser member travels in the first direction. The fuser member axial travel distance may be controlled to be successively shorter for each pass of the fuser member across a home sensor position. After a shortest distance past a home sensor position is traveled during a process, the process may be repeated as necessary for printing operations.

Methods of mitigating edge wear of fuser rolls and fuser belts in fusers, as well as other types of rolls or belts in other apparatuses useful for printing, using dead reckoning techniques can be integrated in closed-loop edge wear control systems. Systems may a data source connected over a link to an input/output interface. A data sink may be connected to the input/output interface through a link. Each of the links can be implemented using any known or later developed device or system for connecting the data source and the data sink, respectively, to a registration distribution system or system for automated axial fuser movement.

The input/output interface may input data from the data source and outputs data to the data sink via the link. The input/output interface may also provide the received data to one or more of a controller, memory, and an algorithm or look-up table. The input/output interface receives data from one or more of the controller, memory, and/or the algorithm or look-up table.

The algorithm or look-up table may provide instructions to the controller based on data to smooth the edge wear profile of the fuser roll. The controller controls the drive motor to move the fuser according to the instruction sent to the controller by the algorithm or look-up table. The algorithm or look-up table may be implemented as a circuit or routine of a suitably programmed general purpose computer.

The memory may stores data received from the algorithm or look-up table, the controller, and/or the input/output interface. The memory may also store control routines used by the controller to operate the drive motor to move the fuser according to the algorithm or look-up table upon receipt of a signal from a sensor. In embodiments, the sensor detects the location of a reference point of the fuser, such as a point on the fuser roll, relative to a fixed position, such as one edge of the media path through the nip.

Systems may be configured wherein one or more sensors may be tripped by a flag provided on the fuser, causing a signal to be sent to the input/output interface. The signal is also sent to the memory and the algorithm or look-up table by way of the bus. The instructions for moving the fuser may be sent from the algorithm or look-up table to the drive motor. The drive motor may be synchronized with the sensor to move the fuser in opposite axial directions.

Although the above description is directed toward fuser apparatuses used in xerographic printing, it will be understood that the teachings and claims herein can be applied to any treatment of marking material on a medium. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions suitable for xerographic fusing.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A method for mitigating fuser member edge wear, comprising:

causing a fuser member to move axially in a first cross-process direction to a first end point by detecting when the fuser member passes a sensor position in the first direction;

causing the fuser member to move in a second cross-process direction after a first period of time elapses;

detecting when the fuser member passes a home sensor position in the second direction;

causing the fuser member to move in the first direction after a first period of time elapses after the fuser member passes the home sensor a first time; and causing the fuser member to move in the second direction after a second period of time elapses, whereby an endpoint of travel along a zone of axial fuser member motion is varied in real-time based on a real-time position of the fuser member, wherein a distance of travel in an end of the zone of the fuser member axial travel is successively decreased.

2. The method of claim 1, the sensor being a limit sensor.

3. The method of claim 1, wherein the second period of time is equal to the first period of time.

4. The method of claim 1, comprising:

causing the fuser member to move in the second direction after a second period of time elapses after the fuser roll passes the limit sensor a second time.

5. The method of claim 1, comprising the fuser member being a fuser roll.

6. The method of claim 1, comprising the fuser member being a fuser belt.

7. The method of claim 1, the sensor being a home sensor, comprising:

detecting when the fuser member passes the home sensor position in the second direction.

8. The method of claim 7, comprising:

causing the fuser member to move in the first direction after a second period of time elapses after the fuser roll passes the home sensor a second time.

9. The method of claim 8, comprising:

causing the fuser member to move in the first direction to a second end point that is different from the first end point by causing the fuser member to move in the second direction after a third time period elapses.

10. The method of claim 9, comprising the third time period being a time period that is different than a first time period and a second time period.

11. The method of claim 9, comprising the third time period being a time period that is different than a time period elapsed during a previous movement of the fusing member in the first direction after passing the home sensor.

12. The method of claim 9, comprising:

causing the fuser member to move in the first direction after a fourth time period, the fourth time period being different than the second time period or a time period elapsed during a previous movement of the fusing member in the second direction after passing the home sensor.

13. The method of claim 12, the fuser member being a fuser roll.

14. A non-transitory computer readable medium containing computer readable instructions, comprising:

causing a fuser member to move axially in a first cross-process direction to a first end point by causing the fuser member to move axially in the first direction at a known speed and detecting when the fuser member passes a sensor position in the first direction; and causing the fuser member to move in a second direction after a first period of time elapses whereby an endpoint of travel along a zone of axial fuser member motion is varied based on a real-time position of the fuser member, wherein a distance of travel in an end of the zone of the fuser member axial travel is successively decreased.

15. The computer readable medium of claim 14, the sensor being a limit sensor, comprising:

detecting when the fuser member passes a home sensor position in the second direction;

causing the fuser member to move in the first direction after a first period of time elapses after the fuser member passes the home sensor a first time; and causing the fuser member to move in the second direction after a second period of time elapses.

16. The computer readable medium of claim 14, detecting when the fuser member passes the home sensor position in the second direction; and causing the fuser member to move in the first direction after a second period of time elapses after the fuser roll passes the home sensor a second time.

17. A method for mitigating fuser member edge wear, comprising:

causing a fuser member to move axially in a first cross-process direction until a first end point;

causing the fuser member to move axially in a second cross-process direction;

causing a fuser member to move axially in the first cross-process direction until a second end point, the second point being different than the first point, whereby an endpoint of travel along a zone of axial fuser member motion is varied based on a real-time position of the fuser member, wherein a distance of travel in an end of the zone of the fuser member axial travel is successively decreased.

18. The method of claim 17, comprising:

detecting when the fuser member reaches the first end point; and detecting when the fuser member reaches the second end point.

19. The method of claim 17, comprising:

causing the fuser member to move axially in the second cross-process direction to a third end point;

causing the fuser member to move axially in the first cross-process direction to a fourth end point; and causing the fuser member to move axially in the second cross-process direction to a fifth end point, the fifth point being different than the third point, and the first point, the second point, the third point, the fourth point, and the fifth point being disposed along a line corresponding to a longitudinal axis of the fuser member whereby an endpoint of travel along a zone of axial fuser member motion is varied based on a real-time position of the fuser member.

* * * * *